US007350443B2

(12) United States Patent
Oakey et al.

(10) Patent No.: US 7,350,443 B2
(45) Date of Patent: Apr. 1, 2008

(54) ASYMMETRICAL CARPET TILE DESIGN, MANUFACTURE AND INSTALLATION

(75) Inventors: David D. Oakey, LaGrange, GA (US); Jerry C. Hall, Woodbury, GA (US); William N. Jones, Westpoint, GA (US)

(73) Assignee: Interface, Inc., Atlanta, GA (US)

( * ) Notice: Subject to any disclaimer, the term of this patent is extended or adjusted under 35 U.S.C. 154(b) by 247 days.

(21) Appl. No.: 11/077,444

(22) Filed: Mar. 10, 2005

(65) Prior Publication Data

US 2005/0210791 A1 Sep. 29, 2005

Related U.S. Application Data

(63) Continuation of application No. 10/165,848, filed on Jun. 7, 2002, now abandoned.

(51) Int. Cl.
*D26D 3/00* (2006.01)
*D26D 1/00* (2006.01)

(52) U.S. Cl. ..... 83/13; 83/39; 428/48; 428/88; 428/92

(58) Field of Classification Search ..... 83/13, 83/39; 428/48, 88, 92
See application file for complete search history.

(56) References Cited

U.S. PATENT DOCUMENTS 1,166,261 A 12/1915 Rogers
D176,500 S 1/1956 Boldt
D178,371 S * 7/1956 Izewshi ..... D25/158
D214,821 S 7/1969 Franco
3,465,384 A 9/1969 Barchi et al.
3,608,799 A 9/1971 Edson
3,673,048 A 6/1972 Gidge et al.
3,768,347 A 10/1973 Wade et al.
3,818,790 A * 6/1974 Culp et al. ..... 83/408
3,850,783 A 11/1974 Peters
3,875,716 A 4/1975 Eusemann
D235,541 S 6/1975 Eusemann
3,943,018 A 3/1976 Petry et al.

(Continued)

FOREIGN PATENT DOCUMENTS

BE 890 436 A 1/1982

(Continued)

OTHER PUBLICATIONS

Jackson, M.R. et al. "Real-time cutting path Determination Using Machine Vision-Based Incremental Pattern Tracking," *Real TIme Imaging*, v. 2 n. 4 Aug. 1996; pp. 249-264.

(Continued)

*Primary Examiner*—Cheryl Juska
(74) *Attorney, Agent, or Firm*—Kilpatrick Stockton LLP; John S. Pratt; Kristin J. Doyle

(57) ABSTRACT

Design and manufacture of floor covering webs for, design, manufacture and installation of, asymmetrical carpet tiles having a prominent design element not intersected by a tile edge. Bands or regions define "frames" around what will become central carpet tile areas so that design elements positioned within the frames will not be intersected by a tile edge and may also be at least a predetermined distance from each tile edge. Design elements also may be positioned differing distances from each of at least one pair of opposed tile edges.

9 Claims, 5 Drawing Sheets

U.S. PATENT DOCUMENTS

| | | | | |
|---|---|---|---|---|
| 3,972,254 | A | | 8/1976 | Dillinger et al. |
| 3,991,663 | A | | 11/1976 | Glasby |
| 4,022,087 | A | | 5/1977 | Queen et al. |
| 4,160,517 | A | | 7/1979 | Buisker |
| 4,242,293 | A | | 12/1980 | Dowd |
| 4,281,598 | A | | 8/1981 | Rump |
| 4,312,686 | A | | 1/1982 | Smith |
| 4,528,882 | A | * | 7/1985 | Axford et al. ..... 83/522.15 |
| 4,545,174 | A | | 10/1985 | Seko |
| 4,555,968 | A | | 12/1985 | Raney et al. |
| 4,656,901 | A | * | 4/1987 | Axford et al. ..... 83/55 |
| 4,819,528 | A | | 4/1989 | Chadwick |
| 4,859,270 | A | | 8/1989 | Martin et al. |
| 4,862,780 | A | | 9/1989 | Memmott et al. |
| 4,919,026 | A | | 4/1990 | Julson, Jr. |
| 5,011,411 | A | | 4/1991 | Loewy |
| 5,198,277 | A | | 3/1993 | Hamilton |
| 5,241,483 | A | | 8/1993 | Porret et al. |
| D341,897 | S | * | 11/1993 | Benavent Adrian ..... D25/138 |
| D353,459 | S | | 12/1994 | Adrian |
| 5,421,802 | A | | 6/1995 | Landeck et al. |
| 5,484,499 | A | | 1/1996 | Marschke |
| 5,563,796 | A | | 10/1996 | Biegger |
| 5,632,831 | A | | 5/1997 | Stull |
| 5,832,802 | A | * | 11/1998 | Warthen et al. ..... 83/555 |
| 5,851,333 | A | | 12/1998 | Fagnant et al. |
| 5,959,632 | A | | 9/1999 | Hashimoto |
| 5,979,278 | A | * | 11/1999 | Warthen et al. ..... 83/20 |
| 5,980,671 | A | | 11/1999 | Delebassee et al. |
| 5,983,815 | A | | 11/1999 | Card |
| 5,989,368 | A | | 11/1999 | Tillander et al. |
| D425,633 | S | | 5/2000 | Hunter |
| 6,086,694 | A | | 7/2000 | Winter et al. |
| 6,203,879 | B1 | | 3/2001 | Desai |
| 6,228,460 | B1 | | 5/2001 | Hamilton et al. |
| 6,833,039 | B2 | | 12/2004 | Andersen et al. |
| 6,841,216 | B2 | * | 1/2005 | Daniel et al. ..... 428/48 |
| 6,849,317 | B1 | * | 2/2005 | Oakey et al. ..... 428/88 |
| 6,905,751 | B2 | | 6/2005 | Jauregui |
| 6,908,656 | B2 | * | 6/2005 | Daniel et al. ..... 428/88 |
| 2001/0052312 | A1 | | 12/2001 | Codos et al. |
| 2002/0012764 | A1 | | 1/2002 | Magee et al. |
| 2002/0046433 | A1 | | 4/2002 | Sellman, Jr. et al. |
| 2002/0067483 | A1 | | 6/2002 | Lacovara |
| 2002/0136855 | A1 | | 9/2002 | Daniel |
| 2003/0118774 | A1 | | 6/2003 | Tippett et al. |
| 2004/0142141 | A1 | | 7/2004 | Jauregui |
| 2005/0166498 | A1 | * | 8/2005 | Oakey et al. ..... 52/273 |
| 2005/0210791 | A1 | * | 9/2005 | Oakey et al. ..... 52/311.1 |

FOREIGN PATENT DOCUMENTS

| | | | | |
|---|---|---|---|---|
| DE | 10140384 | A1 | | 3/2003 |
| EP | 0286902 | | | 5/1992 |
| EP | 0273286 | | | 3/1993 |
| EP | 0543863 | | | 11/1994 |
| EP | 0 698 863 | A | | 2/1996 |
| EP | 0501529 | | | 3/1996 |
| EP | 0636191 | | | 5/1996 |
| EP | 0730686 | | | 9/1998 |
| EP | 0819298 | | | 5/1999 |
| EP | 0763756 | | | 4/2001 |
| GB | 01113796 | | | 5/1968 |
| GB | 1338030 | A | * | 11/1973 |
| GB | 1 537 727 | A | | 1/1979 |
| GB | 01593484 | | | 7/1981 |
| GB | 2 382 526 | B | | 1/2004 |
| GB | 2 400 315 | A | | 10/2004 |
| WO | WO 8200306 | A1 | * | 2/1982 |
| WO | WO 9506548 | A1 | * | 3/1995 |
| WO | WO 99/25525 | | | 3/1999 |
| WO | WO9925525 | | | 5/1999 |
| WO | WO0038605 | | | 12/1999 |
| WO | WO 0143925 | A1 | | 6/2001 |
| WO | WO0151696 | | | 7/2001 |

OTHER PUBLICATIONS

Strashun, J. "To the Max: Web Press Productivity," *Gr. Arts Mon.* suppl. Hatching Profits Sep. 1995, s14-s15.

* cited by examiner

ASYMMETRICAL CARPET TILE DESIGN, MANUFACTURE AND INSTALLATION

CROSS-REFERENCE TO RELATED APPLICATION

This is a continuation application of U.S. patent application Ser. No. 10/165,848, filed Jun. 7, 2002 and entitled Asymmetrical Carpet Tile Design, Manufacture and Installation.

FIELD OF THE INVENTION

This invention relates generally to carpet tiles, a method of designing and manufacturing carpet tiles having a design element positioned in a predetermined area on each carpet tile, and installations of such carpet tile.

BACKGROUND OF THE INVENTION

Carpet tile (modular floor covering having a textile top surface or face) has historically been a product that sought to mimic the appearance of broadloom carpet and to hide or at least de-emphasize the fact that the product was modular. Achieving this result has required, at minimum, that carpet tiles or modules be placed in a flooring installation with the same orientation, and often in the same relative position on the web, that the modules had at the time they were produced. This is because conventional carpet tiles, particularly including tufted, fusion bonded, or woven face carpet tiles, normally have a "direction" as a result of (1) the manufacturing process and/or (2) the pattern on the tiles.

Conventional production of carpet tiles has also had to reflect, in designs incorporated in or placed on the face of tiles, the limitations associated with tile production. For instance, carpet tiles are typically produced by producing a broadloom floor covering "web" having a width that is a multiple of the width of tiles to be cut from it. For instance, typical web widths are approximately six feet or two meters wide. Although other techniques such as weaving are also used, the principal techniques employed for forming the textile face of such floor covering webs are tufting and fusion bonding. After attachment of backing structures to the textile face, the web is cut into tiles or modules, such as, for instance, tiles eighteen inches or one-half meter square.

The appearance of the faces of such carpet tiles are typically produced by the colors and patterns of yarns on the face of the tiles and by printing on the faces of the tiles. Printing of the face of a carpet tile can occur after the floor covering web is cut into tiles, thus making it possible to position the printing on the tile by reference to the tile edges. If the appearance of tiles is produced by tufting the face of floor covering in a particular pattern or by printing the web before it is cut into tiles, it is difficult to control with precision the position of face design elements relative to tile edges. This is true for several reasons. For instance, the face cloth portion of the floor covering web may stretch, shrink or otherwise change shape after it is produced, thereby changing the relative positions of design elements on the face cloth. This can occur, among other reasons, if the face cloth becomes disengaged from one or more tenter pins during manufacture. Expansion or shrinkage of the face cloth can also occur during heating or cooling or in the process of attaching backing structure during the manufacturing process.

It is, of course, possible to locate knives or blades used for cutting carpet tiles from a floor covering web with substantial precision relative to each other (thereby insuring that the tiles will be of a desired uniform size) and relative to other structures of the production equipment, such as tenter hooks. However, because the elements of designs on the face of the floor covering web may not be located precisely in predetermined positions relative to the production equipment (in either of the cross-web or longitudinal directions), it is difficult to cut tiles from the web with precise reference to design elements on the face of the web.

Additional considerations come into play relative to the position of the cuts across the floor covering web (i.e., transverse to its length) that will define carpet tile edges. It is impractical to use the cut that forms the trailing edge of a first set of tiles as the cut that forms the leading edge of tiles of a next set of tiles. It is instead at least frequently necessary as a practical matter to define the leading edge of every tile with a new cut by reference to which the cuts are made that simultaneously form the trailing edge of the same tile. One such new cut can, in effect, establish the reference point for multiple simultaneous cuts parallel thereto and behind the first new cut. For instance, in one known tile cutting device, two or three blade assemblies parallel to the first transverse blade assembly simultaneously cut the web, along with longitudinally oriented blades, to cut the web into eight or twelve tiles (two or three rows of four tiles across the web). The web will then have to advance at least a small distance beyond the front blade assembly before the next cuts that form the next group of tiles.

These factors, together with the other considerations described above, mean that it is at least very difficult to design and form a floor covering web and then cut it into tiles with transverse cuts that fall in precisely predetermined locations on the web.

All of these considerations, as well as others, have tended to cause carpet tile to be designed so that the location of tile-forming cuts on the floor covering web does not matter. For instance, many tiles have no pattern on the tile face and are made in a solid color with either a random yarn pattern or no yarn pattern. Other carpet tile designs use relatively small design elements, again often in a random-appearing pattern, so that tile edges that transect the design elements will not produce unacceptable appearance. Yet another approach is to produce tiles without a pattern on their faces and then print patterns on the faces after the tiles are cut to size and it is possible to position the printing by reference to tile edges.

In light of these considerations, tufted or fusion bonded face carpet tile or other textile face modular floorings generally have not been produced with centered, prominent design elements incorporated in the textile face during manufacture (rather, for instance, than printed on that face).

SUMMARY OF THE INVENTION

In light of the considerations described above, tile-forming cuts cannot easily be positioned with precision relative to features on the face of a floor covering web. However, as a practical matter, it can be predicted (in the sense that it is reasonably possible to insure) that the cuts in a tufted or fusion bonded face floor covering web, and therefore the tile edges produced by such cuts, will fall within predetermined longitudinal and cross-web bands or regions of the web. By utilizing these bands or regions to define "frames" around what will become central carpet tile areas, and by producing webs with relatively uniform appearance in the bands or regions between or outside the frames and more prominent design elements within those frames, it is possible to produce attractive carpet tiles with prominent, generally centered design elements and to produce visually attractive installations of such carpet tiles that differ significantly in appearance from prior installations of carpet tile. While such installations have visually prominent modularity in that there is a one-to-one correspondence between visually prominent design elements and the carpet tiles, the appearance of the installation can mimic a broadloom carpet or an area rug having relatively large scale. Such an attractive installation is particularly possible utilizing, together with the carpet tiles of this invention, "plain" tiles, the entire surfaces of which are a background design such as the design that appears in the frame bands in "background" or "field" or regions of tiles having other design elements.

Because the precise location within the frame-defining bands or regions of tile-forming cuts cannot be predetermined, design elements exactly centered within the conceptual "frames" would not necessarily end up precisely centered in the tiles. At least some of the design elements would end up off center, and in an installation of such tiles some tiles might appear to have misplaced design elements. Accordingly, in some embodiments of this invention, design elements are intentionally positioned so that they will not appear to be centered in the tile carrying them. An assembly of such tiles with multiple off-centered design elements can appear to a viewer to be intentional and attractive. In some embodiments of this invention, such intentional, attractive variation of tile appearance can also be achieved by using design elements having different sizes, shapes or other features of appearance as well as differing off-centered positioning.

DETAILED DESCRIPTION OF THE DRAWINGS

Figure 1:
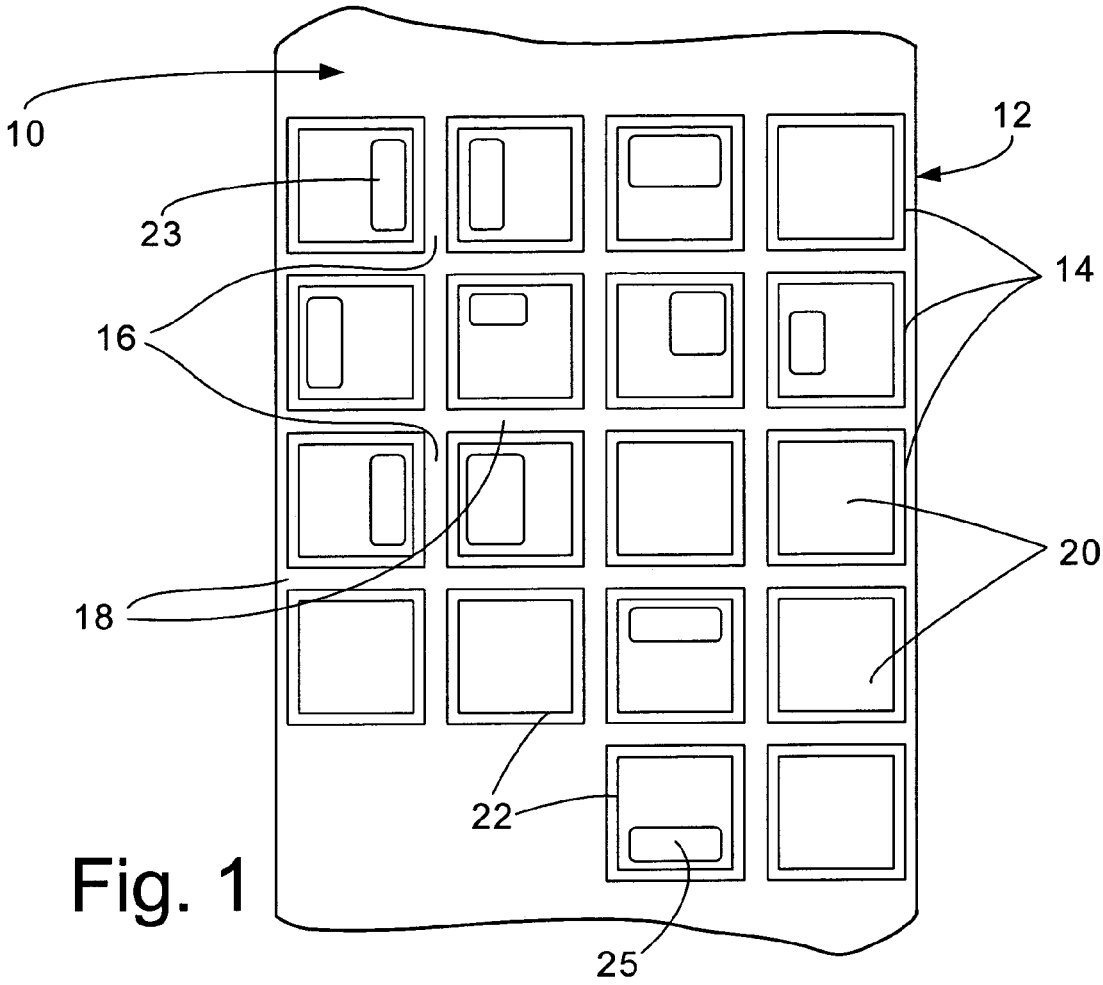
FIG. 1 is a top plan schematic view of an exemplary carpet tile web of this invention showing regions within which design elements and module forming cuts may be positioned.

FIG. 1 depicts the face 10 of a floor covering web 12 on which conceptual or "cutting" frames 14 have been superimposed. Cutting frames 14 divide the face 10 of web 12 into (a) longitudinal cutting regions 16 and transverse cutting regions 18, both of which regions 16 and 18 are outside the cutting frames 14, and (b) design field regions 20, one of which is inside each of the frames 14. All cuts for dividing the web into carpet tiles will fall within these cutting regions 16 and 18 and therefore will not invade any design field region 20. The size and placement of frames 14 in designing a particular floor covering web 12 will be controlled by the realities of the carpet tile manufacturer's ability to control the location of web-dividing cuts. Greater control of cut location on a web 12 can permit larger cutting frames 14 relative to a particular size of tile 24 to be cut from that web 12 (and therefore narrower cutting regions 16 and 18).

While the web 12 can be designed and manufactured with design elements located in any portion of the cutting frame 14, aesthetic considerations may dictate that less than all of the area within a cutting frame 14 be filled with designs. For instance, it may be desirable to confine certain design elements, like design elements 23 and 25, to a conceptual visual frame 22 within each cutting frame 14 to insure that at least the distance between the visual frame 22 and the surrounding cutting frame 14 separates a tile edge from such design elements on its face 10.

Figure 2:
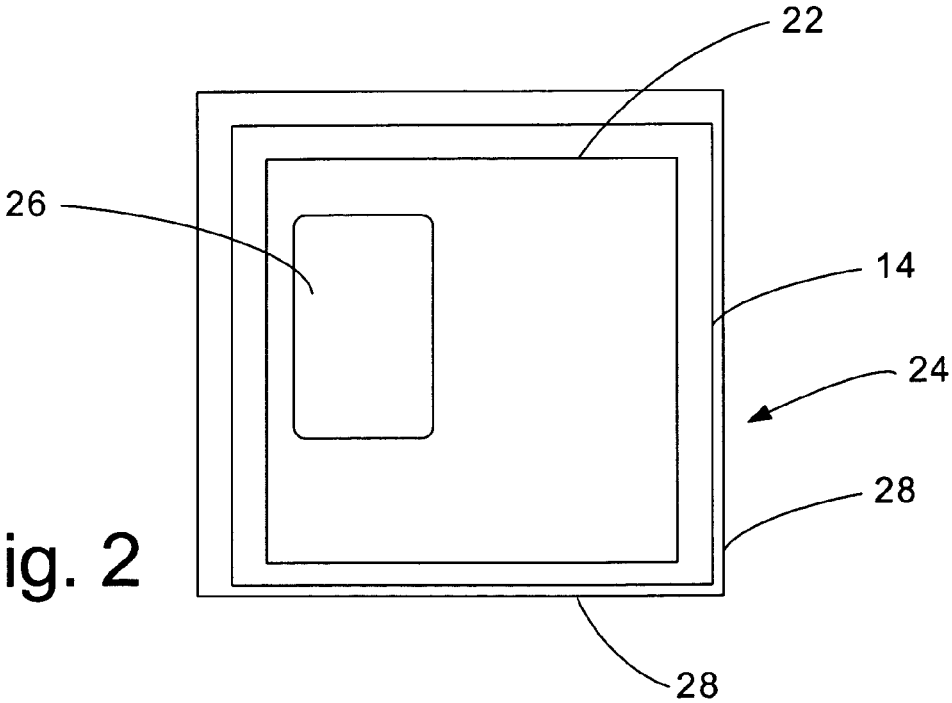
FIG. 2 is a top schematic top plan view of a carpet tile of this invention.

Focusing now on an individual carpet tile or module 24 shown in FIG. 2, a design element 26 (shown as a rectangle with rounded corners) is positioned within visual frame 22. All of cutting frame 14 falls within the face 10 of this tile 24, but cutting frame 14, and therefore visual frame 22, are not centered within tile 24. This does no violence, however, to the appearance of tile 24, in part because design element 26 was not centered within visual frame 22, thereby, in effect, masking the fact that the tile edges 28 are not in precisely predetermined locations relative to the design element 26.

Design element 26 can be produced by any technique causing a visually perceptible result on the face 10 of tile 24, including techniques altering tuft height and appearance, including yarn color. Design element 26 need not be a rectangle but could be any desired shape or collection of shapes or yarn appearances. Design element 26 can be centered in visual frame 22 (and cutting frame 14) either or both of side-to-side or top-to-bottom, but some of the benefits of this invention will be enjoyed only if at least some of the design elements 26 in an installation of tiles 24 are intentionally not centered, as is described above.

Figure 3:
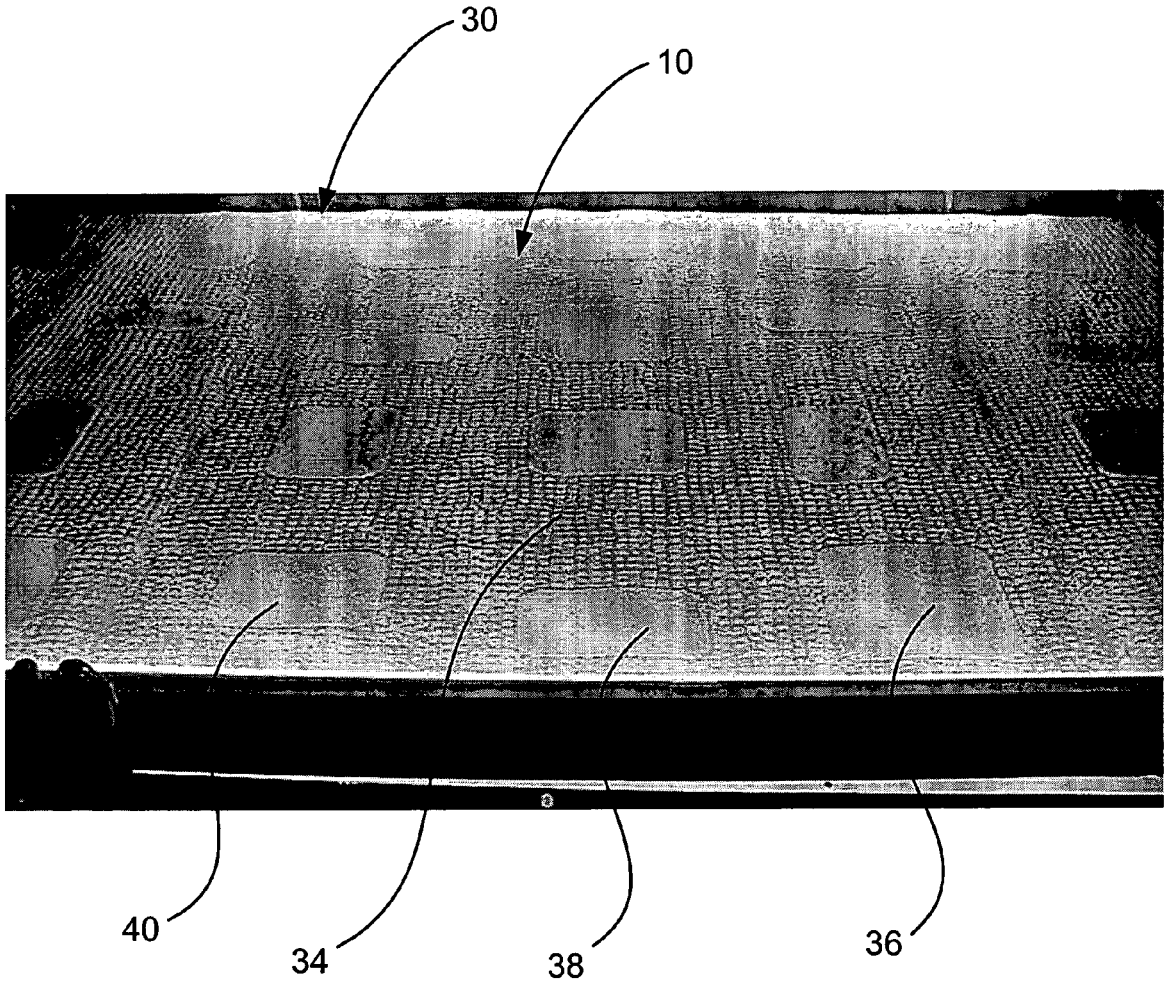
FIG. 3 is a perspective view of the top side carpet web of this invention during manufacture prior to cutting carpet tiles from the web.
Figure 6:
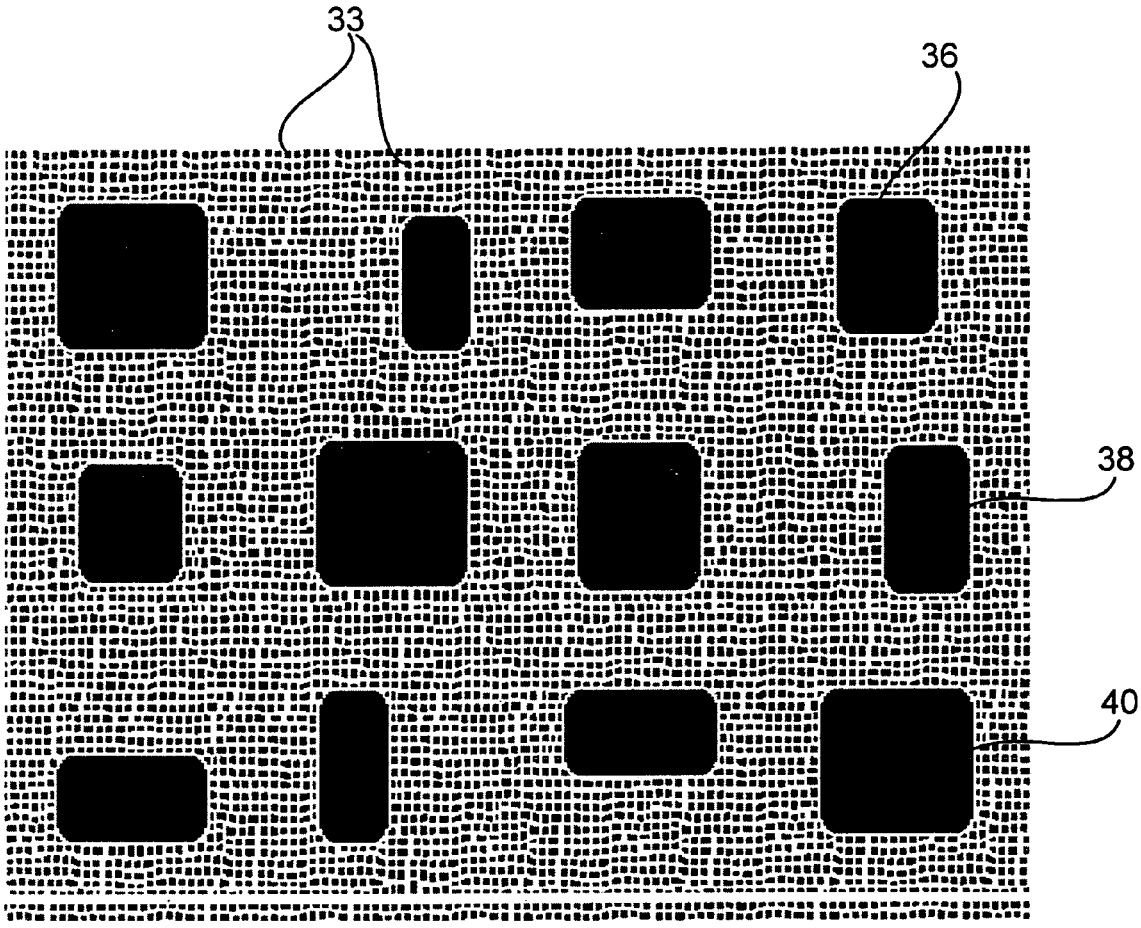
FIG. 6 is the tuft design for the web of FIG. 3.

FIG. 3 shows an example of a floor covering web 30 having a face 10 appearance designed in accordance with this invention. The tufting design is shown in FIG. 6. The design shown in FIG. 6 and embodied in web 30 contemplates cutting the web into four tiles across the web 30 and three tiles along the length of the web 30, after which the design "repeats" for another length equal to three tiles. The FIG. 6 design (embodied in web 30 in FIGS. 3 and 4) shows in black regions of the design where at least some of the tufts, such as the ¼ gauge tufts, are high, meaning that they are taller in the finished product than other of the yarn tufts. Other, white areas of the design shown in FIG. 6 have all of the tufts (in this instance both ⅛ gauge and ¼ gauge tufts) approximately the same, lower height. The FIG. 6 design rendered on web 30 has a "field" or "background" region 34 of small groups of raised tufts (shown as small black areas 33 in FIG. 6) providing a somewhat irregular but uniform appearance. It has larger areas (the design elements 36, 38, 40, etc.) of raised yarn tufts (also shown as black areas 36, 38 and 40 in FIG. 6) forming generally rectangular areas with rounded corners. Thus, the longitudinal "repeat" of this web 30 design is the length of three tiles plus an amount sufficient to accommodate any longitudinal waste that will result when the web 30 is cut into tiles.

Among other alternatives, such a design may be produced on a carpet tufting machine having ¼ gauge and ⅛ gauge needle bars, threaded: ⅛: A B, and ¼: A. The "B" yarn (in the ⅛ gauge needles) is a two color yarn and the "A" yarn in both the ⅛ and ¼ gauge needles is a single color. The ⅛ gauge tufts are all at a selected, uniform height. The heights of the ¼ gauge tufts are controlled so that some of those tufts are at the same height as the ⅛ gauge tufts and other of the ¼ gauge tufts (the ones positioned in the black areas in FIG. 6) are higher in order to form the pattern elements 33, 36, 38 and 40 as explained above.

Figure 4:
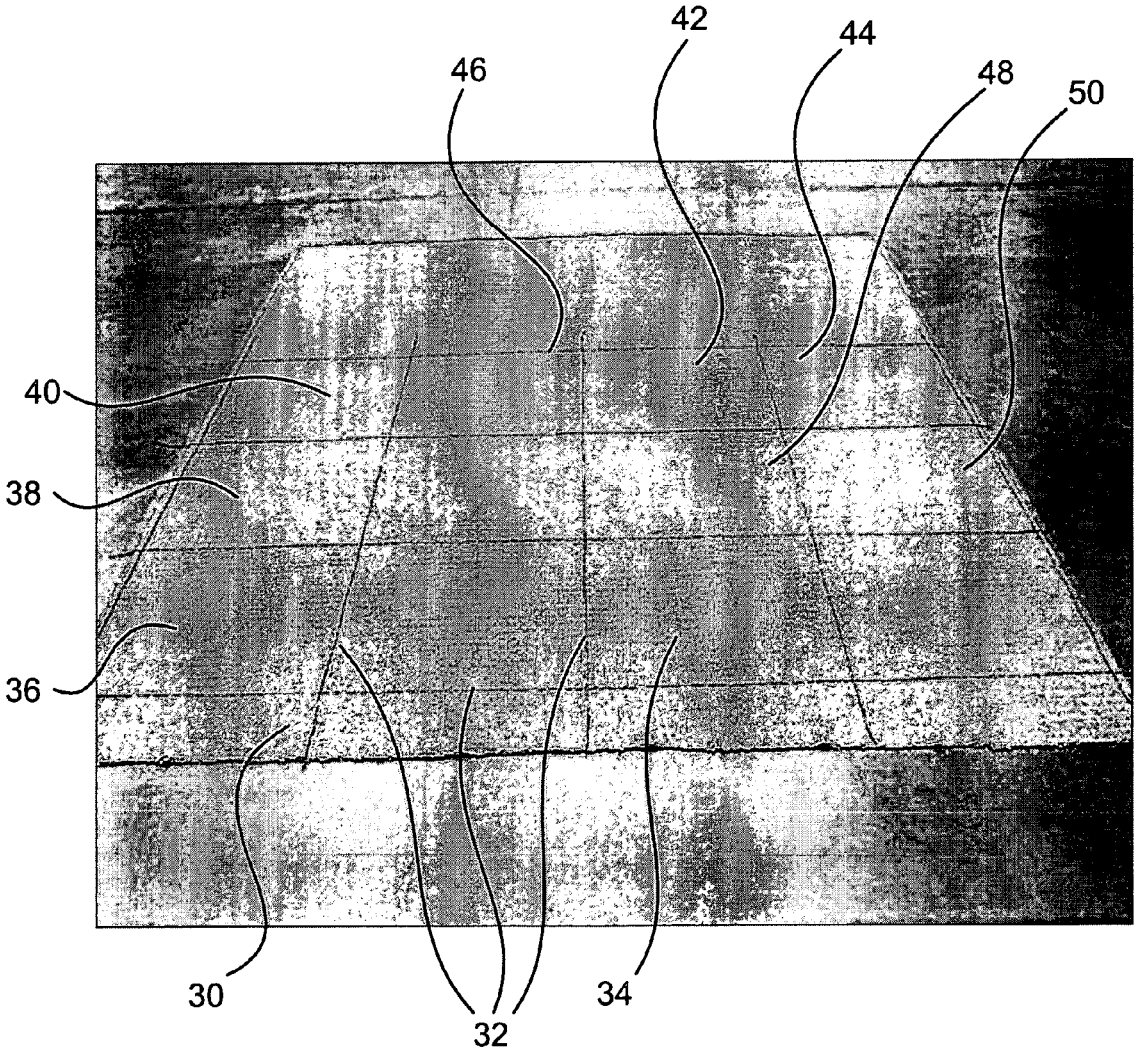
FIG. 4 is a perspective view of a portion of the carpet web shown in FIG. 3 marked to indicate possible locations of cuts to divide the web into tiles.

The relationship between the web design appearing on web 30 in FIG. 3 and the tiles that will be cut from it may be easily appreciated by reference to FIG. 4. FIG. 4 shows a portion of web 30 which has been marked with lines 32 to indicate approximately where the web 30 will be cut to divide it into tiles 42, 44, 48, 50, etc.

Figure 5:
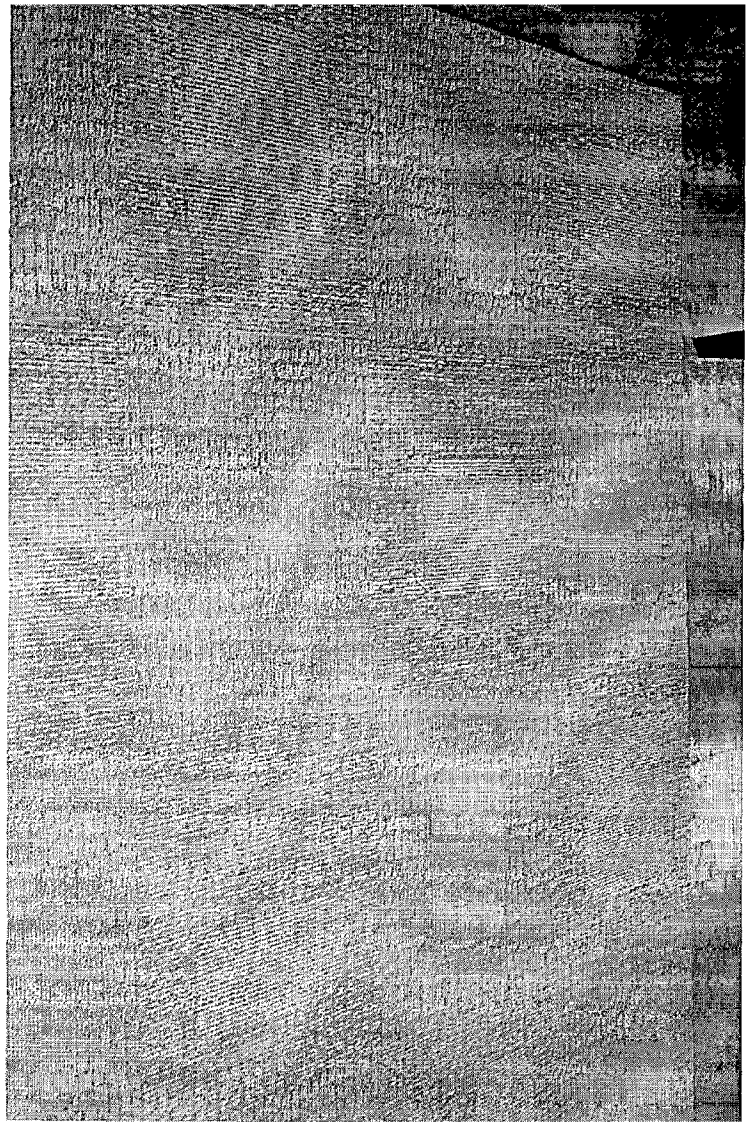
FIG. 5 is a perspective view of an installation of carpet tile of this invention produced from the web shown in FIG. 4.

After tiles 42, 44, 48, 50, etc. are formed, they can be reassembled on a floor in numerous arrangements of similar and dissimilar tiles. One such assembly 52 is shown in FIG. 5, where such tiles have been installed in a "quarter-turn" pattern, meaning that each tile is positioned in an orientation rotated ninety degrees by reference to each adjacent tile. Tiles are typically produced with a direction arrow on the back so that tiles installed with the arrows all pointing in the same direction will be in the same rotational orientation as they had within the web. In the most common tile installation pattern, tiles are placed in straight rows and columns with all of their direction arrows pointing in the same direction. In a "quarter-turn" installation, half of the tiles have their arrow pointing in one direction, and the other half of the tiles have their arrow pointing in a direction offset by ninety degrees from the direction of the arrows of the first half. However, in other situations, tiles of this invention may installed as aligned columns that do not form aligned rows of modules. For example, the tiles may be installed so that a column of tiles appears shifted up or down relative to adjacent tile columns ("the ashlar installation method"). This staggers the horizontal seams or tile edges formed by the adjacency of the "tops" and "bottoms" of tiles within the columns. In yet other installations, a "brick-laid" installation method may be desired in which "rows" of tiles are aligned, but the columns are staggered.

As FIG. 5 demonstrates, the tiles of this embodiment of this invention assemble into a pleasing installation having an attractive appearance in which no tile or element of a tile design appears to be out of place. This is true even though the design elements 36, 38, 40, etc. have different sizes and appear in irregular places from tile to tile since they are not centered within tiles and are not present at the same places within each tile.

As can also be appreciated by reference to FIGS. 4 and 5, the design produced on each tile cut from a longitudinal repeat of the pattern formed on the web 30, in this example totaling twelve tiles, can be different on each tile. In this instance, this results in twelve different tiles cut from each pattern repeat. The "repeat" could also be one, two, or any other number of tiles long. However, corresponding tiles cut from different pattern repeats along the web 30 may also be different from each other because of differences in the exact locations of tile edges. Finally, a huge number of different arrangements of the relative positions of a particular group of tiles is possible when installing tiles on a floor. These factors make it possible, indeed, make it easy to create assemblies of tiles of this invention that differ from each other, while achieving the same general appearance if desired. Additional variations in the appearance of tile installations can be achieved by incorporating into the installation different carpet tiles, such as tiles having only the "background" pattern of region 34, or entirely different tiles carrying an entirely different pattern or color or both.

As should also be apparent from the description above and examination of the Figures, the details of the design of web 30 utilized in this example are merely exemplary and can be substantially altered without departing from the scope and spirit of this invention. Among other variations possible, the sizes of visual frames 22 can be changed, the appearance of the design elements positioned within the visual frame 22 can be altered, and the appearance of background region 34 can be changed.

The exemplary embodiment of this invention shown in FIGS. 3-5 utilizes yarns having 3 plys of 900 denier singles air entangled type 6 nylon, and the appearance differences in the web 30 are achieved by varying the height and other properties of the tufts. Different types and/or colors of yarns could also be used, and pattern elements and field or background region appearances can be achieved utilizing a very wide variety of different conventional and not-yet-developed carpet, fabric and flooring production techniques.

As the above-description and accompanying Figures make apparent, a web pattern can be designed in accordance with this invention by selecting a web width and length and defining a web "blank," the space on a web to be covered by the web design. Cutting frames are then defined within the web blank, which cutting frames define the web space that will not be invaded by cutting a web carrying the web design into tiles. Then desired design elements are defined within the cutting frames. If desired, a visual frame positioned entirely within each cutting frame may be designed and the design elements may be placed entirely within the visual frames to insure that there is a minimum predetermined distance between each tile edge and adjacent portions of the design elements.

The foregoing is provided for the purpose of illustrating, explaining and describing embodiments of the present invention. Further modifications and adaptations of these embodiments will be apparent to those skilled in the art and may be made without departing from the spirit of the invention or the scope of the following claims. For instance, different shapes and sizes of shapes than those illustrated can be used. Similarly, a wide variety of color combinations are possible. Furthermore, while the embodiment described above is tufted, the face fabric could also be woven on a conventional or computer controlled Jacquard or other loom, and the face fabric could be fusion bonded or formed in other manners.

The invention claimed is:

1. A method of producing carpet tiles comprising:

(a) producing a floor covering web carrying a design by:

(i) selecting a web width and length and defining a web blank, (ii) defining within the web blank cutting frames, wherein adjacent cutting frames define cutting regions, and (iii) positioning within each of a plurality of the cutting frames on the web blank at least one design element; and (b) cutting the web along cutting lines located at any position within the cutting regions to form carpet tiles having tile edges, wherein none of the cutting frames are invaded during cutting and wherein each carpet tile cut from the web comprises a pattern having at least one design element positioned at least a predetermined distance from each tile edge.

2. The method of claim 1, wherein positioning within each of the plurality of the cutting frames on the web blank at least one design element further comprises positioning the at least one design element a predetermined distance from the cutting frame.

3. The method of claim 2, wherein positioning the at least one design element a predetermined distance from the cutting frame comprises defining a visual frame within each cutting frame and positioning the at least one design element within the visual frame.

4. A method of producing carpet tiles comprising:

(a) producing a floor covering web carrying a design by:

(i) selecting a web width and length and defining a web blank, (ii) defining within the web blank cutting frames having edges, wherein adjacent cutting frames define cutting regions, (iii) defining a visual frame within each cutting frame and positioned a predetermined distance from the cutting frame within which the visual frame is defined; and (iv) positioning within each visual frame at least one design element; and (b) cutting the web along cutting lines within the cutting regions to form carpet tiles having tile edges, wherein none of the cutting frames are invaded during cutting and wherein each carpet tile cut from the web comprises a pattern having at least one design element positioned at least the predetermined distance from each tile edge.

5. A method for producing carpet tiles that, when assembled on a floor, present a visually continuous appearance of visually perceptible design elements on a relatively uniform background region, the method comprising:

(a) tufting a floor covering web having a relatively uniform background region and visibly identifiable design elements positioned within cutting frames on the web, wherein adjacent cutting frames define cutting regions, and (b) cutting the web along cutting lines located at any position within the cutting regions to form carpet tiles having tile edges and no design elements positioned less than a predetermined distance from any tile edge.

6. The method of claim 5, further comprising assembling the carpet tiles on the floor abutting each other and without regard to the location the tiles occupied on the web before the web was cut into tiles.

7. The method of claim 6, wherein assembling the carpet tiles further is done without regard to the rotational position the tiles occupied on the web before the web was cut into tiles.

8. A method for producing carpet tiles comprising:

(a) tufting a floor covering web having a background region and design elements positioned entirely within cutting frames on the web, wherein adjacent cutting frames define cutting regions, and (b) cutting the web along cutting lines located at any position within the cutting regions to form carpet tiles having tile edges, wherein each carpet tile consists of (i) a portion of the background region which covers the entire tile face except for (ii) a design element positioned no less than a predetermined distance from each tile edge.

9. A method for producing carpet tiles comprising:

(a) tufting a floor covering web having a background region and design elements positioned entirely within cutting frames on the web, wherein adjacent cutting frames define cutting regions, and (b) cutting the web along cutting lines located within the cutting regions to form carpet tiles, each comprising tile edges, a portion of the background region and at least one design element, wherein no design element is positioned less than a predetermined distance from any tile edge.

* * * * *